US008449993B2

(12) United States Patent
Gentleman et al.

(10) Patent No.: US 8,449,993 B2
(45) Date of Patent: May 28, 2013

(54) WETTING RESISTANT MATERIALS AND ARTICLES MADE THEREWITH

(75) Inventors: Molly Maureen Gentleman, Niskayuna, NY (US); James Anthony Ruud, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 788 days.

(21) Appl. No.: 12/550,499

(22) Filed: Aug. 31, 2009

(65) Prior Publication Data

US 2011/0052902 A1 Mar. 3, 2011

(51) Int. Cl.

| | |
|---|---|
| ***B32B 9/00*** | (2006.01) |
| ***B32B 15/04*** | (2006.01) |
| ***B32B 19/00*** | (2006.01) |
| ***F28F 13/18*** | (2006.01) |
| ***F28F 19/02*** | (2006.01) |
| ***F28F 27/00*** | (2006.01) |

(52) U.S. Cl.
USPC ..... 428/701; 165/133; 165/302; 165/913; 428/35.5; 428/469; 428/472; 428/550; 428/702

(58) Field of Classification Search
USPC ..... 165/133, 302, 913; 428/35.5, 469, 428/472, 550, 701, 702
See application file for complete search history.

(56) References Cited

U.S. PATENT DOCUMENTS

| | | | | |
|---|---|---|---|---|
| 7,138,192 | B2 | 11/2006 | Yamada et al. | |
| 7,887,934 | B2 * | 2/2011 | Gentleman et al. | 428/697 |
| 7,892,660 | B2 * | 2/2011 | Gentleman et al. | 428/697 |
| 7,897,271 | B2 * | 3/2011 | Gentleman et al. | 428/697 |
| 7,977,267 | B2 * | 7/2011 | Gentleman et al. | 501/152 |
| 8,057,922 | B2 * | 11/2011 | Gentleman et al. | 428/697 |
| 8,057,923 | B2 * | 11/2011 | Gentleman et al. | 428/697 |
| 8,062,775 | B2 * | 11/2011 | Gentleman et al. | 428/697 |
| 8,173,279 | B2 * | 5/2012 | Gentleman et al. | 428/697 |
| 8,178,219 | B2 * | 5/2012 | Gentleman et al. | 428/697 |
| 8,222,172 | B2 * | 7/2012 | Gentleman et al. | 501/152 |
| 8,236,432 | B2 * | 8/2012 | Gentleman et al. | 428/697 |
| 2007/0281851 | A1 * | 12/2007 | Seneschal-Merz et al. | 501/10 |
| 2008/0187746 | A1 * | 8/2008 | De Graaf et al. | 428/332 |
| 2009/0253570 | A1 * | 10/2009 | Jost et al. | 501/127 |

OTHER PUBLICATIONS

Choe, "Luminescence and Compositional Analysis of Y3Al5O12:Ce films fabricated by pulsed laser deposition", Materials Research Innovation, vol. 6, Nos. 5-6 (2002), 238-241.*
Co-pending U.S. Appl. No. 11/487,023, filed Jul. 17, 2006, entitled "Surfaces and Articles Resistant to Impacting Liquids".
Co-pending U.S. Appl. No. 11/497,096, filed Aug. 1, 2006, entitled "Heat Transfer Apparatus and Systems Including the Apparatus".
Co-pending U.S. Appl. No. 11/497,720, filed Aug. 2, 2006, entitled "Articles Having Low Wettability and Methods for Making".

* cited by examiner

*Primary Examiner* — Jonathan Langman
(74) *Attorney, Agent, or Firm* — Paul J. DiConza

(57) ABSTRACT

Articles coated with wetting resistant materials are presented. One embodiment is an article comprising a substrate and a coating having low surface connected porosity disposed on the substrate. The coating comprises an oxide, which comprises aluminum, yttrium, and at least one rare earth element according to the following atomic proportions:

$$(R_xY_{1-x})_3Al_5O_{12}$$

where x is in the range from about 0.001 to about 0.999, and where R is at least one of the rare earth elements, Y is yttrium, O is oxygen, and Al is aluminum.

25 Claims, 1 Drawing Sheet

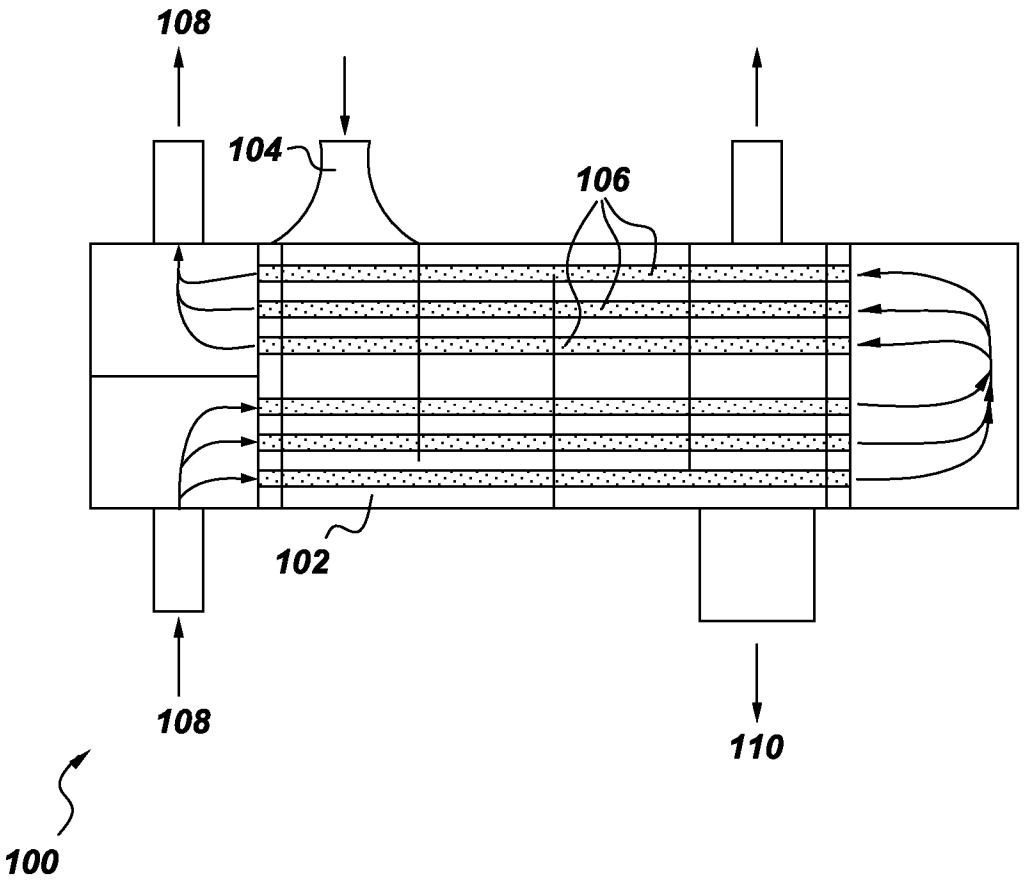
108
104
106
102
108
110
100

WETTING RESISTANT MATERIALS AND ARTICLES MADE THEREWITH

This invention was made with Government support under contract number 70NANB7H7009, awarded by National Institute of Standards and Technology. The Government has certain rights in the invention.

BACKGROUND

This invention relates to wetting resistant materials. More particularly, this invention relates to articles that include coatings of wetting resistant materials.

The "liquid wettability", or "wettability," of a solid surface is determined by observing the nature of the interaction occurring between the surface and a drop of a given liquid disposed on the surface. A high degree of wetting results in a relatively low solid-liquid contact angle and large areas of liquid-solid contact; this state is desirable in applications where a considerable amount of interaction between the two surfaces is beneficial, such as, for example, adhesive and coating applications. By way of example, so-called "hydrophilic" materials have relatively high wettability in the presence of water, resulting in a high degree of "sheeting" of the water over the solid surface. Conversely, for applications requiring low solid-liquid interaction, the wettability is generally kept as low as possible in order to promote the formation of liquid drops having high contact angle and thus minimal contact area with the solid surface. "Hydrophobic" materials have relatively low water wettability (contact angle generally at or above 90 degrees); so-called "superhydrophobic" materials (often described as having a contact angle greater than 120 degrees) have even lower water wettability, where the liquid forms nearly spherical drops that in many cases easily roll off of the surface at the slightest disturbance.

Heat transfer equipment, such as condensers, provide one example of an application where the maintenance of surface water as droplets rather than as a film is important. Two alternate mechanisms may govern a condensation process. In most cases, the condensing liquid ("condensate") forms a film covering the entire surface; this mechanism is known as filmwise condensation. The film provides a considerable resistance to heat transfer between the vapor and the surface, and this resistance increases as the film thickness increases. In other cases, the condensate forms as drops on the surface, which grow on the surface, coalesce with other drops, and are shed from the surface under the action of gravity or aerodynamic forces, leaving freshly exposed surface upon which new drops may form. This so-called "dropwise" condensation results in considerably higher heat transfer rates than filmwise condensation, but dropwise condensation is generally an unstable condition that often becomes replaced by filmwise condensation over time. Efforts to stabilize and promote dropwise condensation over filmwise condensation as a heat transfer mechanism in practical systems have often required the incorporation of additives to the condensing medium to reduce the tendency of the condensate to wet (i.e., form a film on) the surface, or the use of low-surface energy polymer films applied to the surface to reduce film formation. These approaches have drawbacks in that the use of additives may not be practical in many applications, and the use of polymer films may insert significant thermal resistance between the surface and the vapor. Polymer films may also suffer from low adhesion and durability in many aggressive industrial environments.

Texturing or roughening the surface can change the contact angle of water on a surface. A texture that increases the tortuosity of the surface but maintains the contact between water droplet and the surface will increase the contact angle of a hydrophobic material and decrease the contact angle of a hydrophilic material. In contrast, if a texture is imparted that maintains regions of air beneath a water droplet, the surface will become more hydrophobic. Even an intrinsically hydrophilic surface can exhibit hydrophobic behavior if the surface is textured to maintain a sufficiently high fraction of air beneath the water drop. However, for applications requiring highly hydrophobic or superhydrophobic behavior, it is generally more desirable in practice to texture a hydrophobic surface than to texture a hydrophilic surface. An intrinsically hydrophobic surface usually provides the potential for a higher effective contact angle after texturing than an intrinsically hydrophilic surface, and generally provides for a higher level of wetting resistance even if the surface texturing becomes less effective over time as the texture wears away.

Relatively little is known about the intrinsic hydrophobicity of broad classes of materials. In general, most of the materials known to have a contact angle with water of greater than 90 degrees are polymers such as tetrafluoroethylene, silanes, waxes, polyethylene, and propylene. Unfortunately, polymers have limitations in temperature and durability that can limit their application, because many practical surfaces that would benefit from low wettability properties are subject in service to high temperatures, erosion, or harsh chemicals.

Ceramic materials are typically superior to polymers in many aspects related to durability. Of the ceramic materials, oxide ceramics are particularly useful because they are highly manufacturable, often have high environmental resistance, and can have good mechanical properties. Unfortunately, there are virtually no known oxide ceramics that are hydrophobic. A notable exception is silicalite, a zeolitic polymorph of SiO2 [E. M. Flanigen, J. M. Bennett, R. W. Grose, J. P. Cohen, R. L. Patton, R. M. Kirchner, and J. V. Smith, "Silicalite, a new hydrophobic crystalline silica molecular sieve," *Nature*, v. 271, 512 (1978)]. For that material the specific crystal structure is highly important because amorphous SiO2 has a very low, hydrophilic wetting angle. However, the synthesis conditions required to form zeolite crystals can limit the range of applicability of those materials as hydrophobic surfaces and the porosity of zeolite crystals makes them less desirable for applications requiring durability.

Therefore, there remains a need in the art for oxide ceramics that have lower liquid wettability than conventional oxides, promote stable dropwise condensation, are stable at elevated temperatures, are amenable to coating processing, and have good mechanical properties. There is also a need for articles coated with these wetting resistant oxide ceramics.

BRIEF DESCRIPTION

Embodiments of the present invention are provided to meet these and other needs. One embodiment is an article comprising a substrate and a coating having low surface connected porosity disposed on the substrate. The coating comprises an oxide, which comprises aluminum, yttrium, and at least one rare earth element according to the following atomic proportions:

$$(R_xY_{1-x})_3Al_5O_{12}$$

where x is in the range from about 0.001 to about 0.999, and where R is at least one of the rare earth elements, Y is yttrium, O is oxygen, and Al is aluminum.

DRAWINGS

These and other features, aspects, and advantages of the present invention will become better understood when the following detailed description is read with reference to the accompanying drawings in which like characters represent like parts throughout the drawings, wherein:

FIG. 1 is a schematic of a surface condenser.

DETAILED DESCRIPTION

Embodiments of the present invention are based upon the discovery by the inventors of a class of oxide ceramics that shows certain surprising properties. First, they tend to have significantly lower water wettability than commonly known engineering oxides. Some compositions are intrinsically hydrophobic. Moreover, some compositions, even those not intrinsically hydrophobic, have demonstrated the ability to maintain stable dropwise water condensation, making them intriguing candidates for use in heat transfer applications, for instance. Without being bound by theory, it is suspected that this behavior is related to the nature of the oxygen-cation bonding occurring within the crystal structure of the oxide. Finally, certain compositions are transparent to ultraviolet, visible, or infrared radiation, meaning they allow at least about 70% of the incident radiation to transmit through the material. Such compositions may allow for wetting-resistant windows and other useful applications, as will be discussed further herein.

The materials described herein may be a mixture or a compound of multiple oxides. Throughout this description, the composition of the material may be described in terms of its component oxides, such as, for example, alumina and yttria, even if these component oxides are technically not present in the material due to interactions such as phase transformations and chemical reactions. This notation is consistent with that commonly used in the art, where, for example, a compound such as yttrium aluminum garnet may be interchangeably denoted as $0.375Y_2O_3.0.625\ Al_2O_3$, or $Y_3Al_5O_{12}$.

It will be appreciated that where materials and articles are described herein as "comprising" or "including" one or more components, the scope of the description includes, without limitation, materials made only of the stated components; materials made of the stated components and including other components that do not materially affect the wettability of the material; and materials including the stated components but not excluding other components. Moreover, where lists of alternatives are provided, the alternatives are not meant to be exclusive; one or more of the alternatives may be selected, except where otherwise explicitly stated.

One embodiment of the present invention is an article comprising a substrate and a coating disposed on the substrate. The coating comprises an oxide, and this oxide comprises aluminum, yttrium, and one or more rare earth elements. These constituents are included in the oxide according to the following atomic proportions:

$$(R_xY_{1-x})_3Al_5O_{12} \quad \text{(equation 1);}$$

where x is in the range from about 0.001 to about 0.999, and where R is at least one of the rare earth elements, Y is yttrium, O is oxygen, and Al is aluminum.

As used herein, "rare earth elements" refers to the elements of the Lanthanide Series (atomic numbers 57-71), scandium, and yttrium.

A wide variety of values for x were investigated, and the Example set forth below describes one particular value of x for illustrative purposes. However, the effects of rare earth content on the wetting properties of the oxide were surprisingly sensitive, in that even small amounts of rare earth content provided significantly different behavior. For instance, while undoped yttrium aluminum oxide demonstrated filmwise condensation, values for x of just 0.01 (for R as cerium, and for R as lanthanum) showed dropwise condensation and significantly increased contact angle. However, specimens tested at x=1 did not promote dropwise condensation. In some embodiments, x is in the range from about 0.001 to about 0.50, and in particular embodiments, x is in the range from about 0.001 to about 0.25. In certain embodiments, having a lower value of x may reduce the amount of secondary phase present in the coating in addition to the oxide described above (see below for further discussion of secondary phases). In some cases it may be desirable to reduce or even minimize the amount of secondary phase present. For instance, certain rare earth oxides, such as lanthanum oxide, praseodymium oxide, and neodymium oxide, are hygroscopic, which may not be a desirable characteristic in some applications. In other cases a higher amount of secondary phase may be tolerable. The selection of the proper value for x in a given embodiment depends in part on the nature of the application, the performance level desired for the coating, and the identity and characteristics of the secondary phase.

In some embodiments, the oxide makes up at least about 50% by volume of the coating. In another embodiment, the oxide makes up at least about 75% by volume of the coating, and in particular embodiments, the oxide makes up at least about 90% of the coating, including embodiments in which the coating is essentially all made up of the oxide (barring incidental impurities). The amount of oxide selected for the coating will depend in part upon the nature of the application of the coated article.

In one embodiment, the oxide of the coating comprises an amorphous phase. In some embodiments, at least about 25% by volume of the oxide present in the coating is amorphous. In certain embodiments, amorphous material makes up at least 50% by volume of the oxide, while in particular embodiments, the amorphous material makes up at least 80% of the oxide, including embodiments where the oxide is essentially all amorphous material. Thus the term "oxide" as used herein is not limited to only crystalline oxide materials, but additionally encompasses noncrystalline ("amorphous") compositions.

In some embodiments that include amorphous phase in the oxide, the rare earth element is one or more of lanthanum, cerium, praseodymium, and neodymium. Certain amorphous compositions where the rare earth element includes cerium surprisingly have shown attractive wettability characteristics. In some embodiments, where R includes cerium or lanthanum, for example, the value of x in the above formula is in the range from about 0.001 to about 0.10, and in particular embodiments, the upper limit on this range is about 0.01. Compositions within these ranges have shown the ability to promote stable dropwise condensation, and even a small amount of, for example, cerium, such as x=0.01, appears to significantly increase the static contact angle with water when compared to amorphous compositions of yttrium aluminum oxide without the cerium addition. In certain embodiments, R includes lanthanum, which also appears to enhance contact angle and to promote dropwise condensation.

In some embodiments, the oxide comprises a crystalline garnet phase, meaning the phase has the commonly known garnet crystal structure associated with yttrium aluminum garnet (also referred to in the art as YAG, with a chemical formula of $Y_3Al_5O_{12}$). The garnet phase makes up at least about 50% of the oxide in some embodiments, and in certain embodiments the garnet phase makes up at least about 80% of the oxide. In particular embodiments, the garnet phase makes up essentially 100% of the oxide, excluding incidental impurities. The selection of the level of garnet present in the oxide will depend in part on the nature of the application of the coated article.

The garnet phase referred to above typically comprises, in addition to yttrium and aluminum, at least one rare earth element. In particular embodiments, the rare earth element is one or more of lanthanum, cerium, praseodymium, and neodymium.

In some embodiments, the garnet phase comprises cerium. In some of these cerium-containing embodiments, the x value from equation 1 above is in the range from about 0.001 to about 0.50, and in particular embodiments, this range is from about 0.001 to about 0.25. Compositions having cerium at these levels have demonstrated remarkable wettability properties, including contact angles (with water) of 90 degrees or greater, and promotion of stable dropwise condensation.

In some embodiments, the garnet phase comprises lanthanum. In some of these lanthanum-containing embodiments, the x value from equation 1 above is in the range from about 0.001 to about 0.50, and in particular embodiments, this range is from about 0.001 to about 0.25. Compositions having lanthanum at these levels, like the cerium-containing embodiments described above, have demonstrated remarkable wettability properties, including contact angles (with water) of 90 degrees or greater, and promotion of stable dropwise condensation.

The solubility of rare earth elements in YAG is fairly low, generally less than about 2 atomic percent. Thus, compositions as described above include embodiments in which the garnet phase is saturated with the rare earth element(s). Moreover, it is clear that in certain embodiments, the coating will contain an excess level of rare earth element(s) beyond the saturation limit of the garnet phase, and thus in such embodiments the coating comprises a secondary oxide in addition to the garnet oxide. This secondary oxide is generally also an oxide that comprises a rare earth element (thus making an oxide that is a "rare earth oxide"). The overall composition of the coating, including the relative proportions of garnet and secondary oxide, can be fairly readily predicted where the amount of rare earth-containing material present in the coating is known. This predictability of composition may allow for desirable control in selection of properties (such as, for instance, wettability, durability, optical properties, etc.) for a given application.

In some embodiments, the coating has a low level of surface connected porosity, such as up to about 5 percent by volume. In certain embodiments, the surface connected porosity is even lower, such as lower than 2 percent, lower than 1 percent, lower than 0.5 percent, or lower than 0.1 percent (all percentages by volume), depending on the requirements of the desired application. In some embodiments, the coating is made of material that is substantially theoretically dense. A low content of surface connected porosity may inhibit the absorption of water into a pore network, thereby keeping liquid at the surface of the article. Even a surface made of highly hydrophobic material, for instance, may absorb water if the amount of open porosity is unduly high, thereby rendering the surface ineffective as a barrier to water.

In stark contrast, other applications of materials possibly similar those described herein require much higher open (surface connected) porosity. For instance, in U.S. Pat. No. 7,138,192, a YAG surface layer is applied to an article used in semiconductor manufacturing systems to enhance the ability of a surface to catch and retain reaction by-products. This patent specifies an open porosity of not lower than 10 volume percent, which may render the coating unsuitable for use in applications, such as those described herein, where wettability of the surface, particularly the ability of the surface to repel and shed liquids, is an important characteristic.

In some embodiments, the article described above comprises a substrate, such as a metal substrate, for example, upon which the aforementioned coating is disposed. Examples of metal substrates include metals and alloys made with aluminum, steel, stainless steel, nickel, copper, or titanium. In particular, common engineering alloys such as 306 stainless steel, 316 stainless steel, 403 stainless steel, 422 stainless steel, Custom 450 stainless steel, commercially pure titanium, Ti-4V-6Al, and 70Cu-30Ni are non-limiting examples of suitable substrate materials.

Various intermediate coatings may be applied for any reason, such as to achieve desired levels of adhesion between substrate and coating, depending on the nature of the materials involved and the selected methods for processing the materials. Such variations generally are within the knowledge of one skilled in the art. Thickness of the coating will depend upon the nature of the environment and the application envisioned for the article. For example, in a heat exchanger application, the coating is typically designed to minimize thermal resistance between the environment and the substrate while achieving a practical service lifetime. Determination of the coating thickness for a given application is within the knowledge of one skilled in the art.

In some embodiments the coating has a low level of overall porosity, such as lower than about 5 percent by volume. In certain embodiments, the overall porosity of the coating is even lower, such as lower than about 1 percent. In some embodiments, the coating is substantially theoretically dense throughout. The overall porosity of the coating, like the thickness of the coating described above, plays a role in determining the thermal resistance of the article: higher porosity typically results in high thermal resistance. Thus, maintaining a low overall porosity may be important in embodiments where low thermal resistance is desirable.

Any manufacturing method useful for fabrication and/or deposition of ceramic oxide materials may be used for fabricating the materials and articles described herein. Accordingly, embodiments of the present invention include a method for protecting an article from a liquid-containing environment, comprising applying a coating to a substrate, where the coating comprises any of the materials described herein.

Examples of well-known processes capable of making ceramic oxide materials include powder processing, thermal spray deposition (including, for instance, plasma spray deposition techniques), sol-gel processing, chemical vapor deposition and physical vapor deposition. In powder processing methods, a ceramic article is formed from ceramic particles using a method such as pressing, tape casting, tape calendaring or screen printing, and then consolidating and densifying the powders using a sintering process. Sol-gel processing methods provide a ceramic precursor in liquid form to a substrate after which the ceramic material is substantially formed through chemical reactions such as hyrdrolyzation and polymerization, and subsequently heat-treated to produce and densify the ceramic material. Chemical vapor deposition methods involve providing gaseous precursor molecules to a heated substrate to form a ceramic article and include atmospheric pressure chemical vapor deposition, low-pressure chemical vapor deposition, metal-organic chemical vapor deposition and plasma enhanced chemical vapor deposition. Physical vapor deposition processes produce a vapor of material from solid precursors and supply the vapor to a substrate to form a ceramic article. Physical vapor deposition processes include sputtering, evaporation, and laser deposition. Plasma spray deposition produces a coating through the injection of a feedstock, generally a particulate material, into a plasma flame, whereupon the particles are rapidly heated and accelerated prior to striking the substrate surface. Processing parameters such as the power applied to the plasma, the distance from the plasma spray torch to the substrate, the relative speed at which the torch traverses over the substrate, and other parameters, can be manipulated to achieve desired levels of density, rates of deposition, surface finish, and other coating properties.

In the case of bulk ceramic articles, the substrate is used to form the ceramic body in the form of a crucible, die or mandrel and subsequently removed. In the case of ceramic coatings, the ceramic article remains attached to the substrate. The processing methods can be selected and tailored by a practitioner skilled in the art to produce the desired control of chemical composition and density of the ceramic oxide articles.

In some embodiments, the coating further comprises a surface texture to further improve the wetting-resistant properties of the article. A surface texture comprises features disposed at the exterior surface (that is, the surface exposed to the ambient environment); examples of such features include, without limitation, elevations (such as cylindrical posts, rectangular prisms, pyramidal prisms, dendrites, nanorods, nanotubes, particle fragments, abrasion marks, and the like); and depressions (such as holes, wells, and the like). In some embodiments, the surface texture serves to increase the tortuosity of the surface, which may increase the contact angle of a hydrophobic material. In other embodiments, the features are sized and configured to create pockets of air between a drop of liquid and the surface, which can reduce the effective surface energy and produce a higher contact angle than would be expected for a smooth surface. Examples of such textures and methods for generating them are described in commonly owned U.S. patent application Ser. Nos. 11/497,096; 11/487,023; and 11/497,720; which are incorporated by reference herein in their entireties.

One particular exemplary embodiment of the present invention is a wetting-resistant article. The article comprises a coating situated to be routinely exposed to a liquid phase, meaning that the coating is positioned in/on the article such that, during normal operation or maintenance of the article, the coating is likely to come into contact with a liquid phase such as water via any mechanism, including, as examples, condensation or impact. Examples of such articles include condensers, windows, steam turbine blades, or any component commonly exposed to moisture or humidity during operation or service. The coating comprises the oxide coating materials described herein.

The novel properties described for the above embodiments lend themselves to a host of useful applications where resistance to wetting by liquids is desirable. A condenser used, for instance, to transfer heat between a hot vapor and a cooling fluid, such as is used in chemical processing, water desalination, and power generation, is an example of an embodiment of the present invention using the articles and materials described above. FIG. 1 illustrates one common type of condenser: the surface condenser 100. Steam, for example, enters shell 102 through inlet 104, whereupon it is condensed to water on the exterior surface of condensation tubes 106, through which flows a cooling fluid 108, such as water. The coating (not shown) described above is disposed on this exterior surface of the condensation tubes 106, thereby promoting dropwise condensation of condensate water from the steam. The condensate is easily shed from the tubes 106 by the coating and exits from shell 102 via condensate outlet 110.

In certain applications, such as, for example, steam turbines, metal components are subject to impinging drops of water as well as condensing drops. As steam expands in a turbine, water droplets (typically fog-sized) appear in the flow stream. These droplets agglomerate on the turbine blades and other components and shed off as larger drops that can cause thermodynamic, aerodynamic, and erosion losses in turbines. The ability to shed water droplets from components before they have a chance to agglomerate into substantially larger drops is thus important to maximize system lifetime and operation efficiency. As noted above, many of the coating compositions described herein promote dropwise condensation, so that liquid is shed from the surface in small drops rather than in larger sheets. Accordingly, embodiments of the present invention include a steam turbine assembly comprising the article described above. In particular embodiments, the article is a component of a steam turbine assembly, such as a turbine blade, a turbine vane, or other component susceptible to impingement of water droplets during turbine operation.

Certain embodiments of the present invention may reduce the formation, adhesion, and/or accumulation of ice on surfaces. Icing takes place when a water droplet (sometimes supercooled) impinges upon the surface of an article, such as an aircraft component or a component of a turbine assembly (for example, a gas or wind turbine), and freezes on the surface. The build-up of ice on aircraft, turbine components, and other equipment exposed to the weather, increases safety risks and generates costs for periodic ice removal operations. Certain embodiments of the present invention include an aircraft that comprises the articles and materials described above; a component of such an aircraft suitable to serve as the embodied article may include, for example, a wing, tail, fuselage, or an aircraft engine component. Non-limiting examples of aircraft engine components that are suitable as articles in embodiments of the present invention include the nacelle inlet lip, splitter leading edge, booster inlet guide vanes, fan outlet guide vanes, sensors and/or their shields, and fan blades.

Icing is a significant problem for wind turbines, as the build-up of ice on various components such as anemometers and turbine blades reduces the efficiency and increases the safety risks of wind turbine operations. Wind turbine blades and other components are often made of lightweight composite materials such as fiberglass in order to save weight, and the build-up of ice can deleteriously load the blades to a point that significantly reduces their effectiveness. In certain embodiments of the present invention, an article as described above is a component, such as a turbine blade, anemometer, gearbox, or other component, of a wind turbine assembly.

As other components exposed to the weather are also adversely affected by ice and/or water accumulation, other embodiments may include, for instance, components of other items exposed to the weather, such as power lines and antennas. The ability to resist wetting may benefit a host of components that are so exposed, and the examples presented herein should not be read as limiting embodiments of the present invention to only those named applications.

One particularly useful potential application for some of the materials described herein include applications involving the transmission of electromagnetic radiation, especially infrared (IR), visible, and/or ultraviolet (UV) radiation. Those skilled in the art will appreciate that many of the oxides described herein, such as lanthanum-doped yttrium aluminum garnet, for instance, readily transmit radiation over significant portions of the visible and near visible (IR and UV) spectrum. Transparent oxides may be formed according to the methods described herein by controlling the composition and microstructure of the oxides. For example, where transparency is desired for a specified wavelength range, component oxides may be selected that do not substantially absorb in that range, and the material is then processed according to known methods to minimize defects that would scatter incident radiation. In particular embodiments of the articles described previously, the coating comprises a material that is transparent to electromagnetic radiation of at least one type selected from the group consisting of ultraviolet radiation, visible light, and infrared radiation. In particular embodiments, the substrate comprises a material that is also transparent to the radiation. One example of a potentially useful application of the transparent material described above includes photovoltaic devices. Another example is a window of any type. Here "window" embraces any component designed to allow at least some incident visible or near visible radiation to transmit; examples include, but are not limited to, windows for buildings, windshields for vehicles, and components of sensors designed to sense or emit certain wavelengths of radiation. The hydrophobic and/or dropwise condensation-promoting properties of the coatings described herein allow the potential for windows and the like that easily shed dirt and water that may otherwise foul the surface and detract from performance.

EXAMPLES

Without further elaboration, it is believed that one skilled in the art can, using the description herein, utilize the present invention to its fullest extent. The following examples are included to provide additional guidance to those skilled in the art in practicing the claimed invention. The examples provided are merely representative of the work that contributes to the teaching of the present application. Accordingly, these examples are not intended to limit the invention, as defined in the appended claims, in any manner.

Example 1

A coating in accordance with embodiments described herein was deposited on a stainless steel substrate by a thermal spray process. The powder used for deposition of the coatings was produced by mixing a commercially available yttrium aluminum garnet powder ($Y_3Al_5O_{12}$) with cerium nitrate, drying the mixture, and calcining to produce a cerium doped garnet powder. X-ray diffraction confirmed that the resulting material had the garnet crystal structure and that cerium was present within the garnet crystal lattice. The final composition of the powder was approximately $(Y_{0.99}Ce_{0.01})_3Al_5O_{12}$. A coating with a thickness of about 200 micrometers was deposited on the substrate and the surface of the coating was polished to a mirror finish. The static water contact angle for this surface was approximately 86 degrees and the coating promoted dropwise condensation in the presence of steam.

Example 2

A coating in accordance with embodiments described herein was deposited on a stainless steel substrate by a thermal spray process. The powder used for deposition of the coatings was produced by mixing a commercially available yttrium aluminum garnet powder ($Y_3Al_5O_{12}$) with lanthanum nitrate, drying the mixture, and calcining to produce a lanthanum doped garnet powder. X-ray diffraction confirmed that the resulting material had the garnet crystal structure and that lanthanum was present within the garnet crystal lattice. The final composition of the powder was approximately $(Y_{0.9}La_{0.1})_3Al_5O_{12}$. A coating with a thickness of about 200 micrometers was deposited on the substrate and the surface of the coating was polished to a mirror finish. The static water contact angle for this surface was approximately 82 degrees and the coating promoted dropwise condensation in the presence of steam.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An article comprising:

a surface condenser comprising a condensation tube having a coating disposed on the condensation tube, wherein the coating has a surface connected porosity of up to 5 percent by volume, and comprises an oxide, the oxide comprising aluminum, yttrium, and at least one rare earth element according to the following atomic proportions:

$$(R_xY_{1-x})_3Al_5O_{12}$$

where x is in the range from about 0.001 to about 0.999, and where R is at least one of the rare earth elements, Y is yttrium, O is oxygen, and Al is aluminum.

2. The article of claim 1, wherein x is in the range from about 0.001 to about 0.50.

3. The article of claim 1, wherein x is in the range from about 0.001 to about 0.25.

4. The article of claim 1, wherein the oxide comprises an amorphous phase.

5. The article of claim 4, wherein the rare earth element is selected from the group consisting of lanthanum, cerium, praseodymium, and neodymium.

6. The article of claim 4, wherein R comprises cerium.

7. The article of claim 6, wherein x is in the range from about 0.001 to about 0.10.

8. The article of claim 4, wherein the oxide comprises lanthanum.

9. The article of claim 8, wherein x is in the range from about 0.001 to about 0.10.

10. The article of claim 1, wherein the oxide consists essentially of an amorphous phase.

11. The article of claim 1, wherein the oxide comprises a crystalline garnet phase, the garnet phase comprising aluminum, yttrium, and at least one rare earth element.

12. The article of claim 11, wherein the garnet phase is present in the oxide at a level of at least about 50% by volume.

13. The article of claim 11, wherein the garnet phase is present in the oxide at a level of at least about 80% by volume.

14. The article of claim 11, wherein the garnet phase is saturated with the at least one rare earth element.

15. The article of claim 11, wherein the at least one rare earth element is selected from the group consisting of lanthanum, cerium, praseodymium, and neodymium.

16. The article of claim 11, wherein the garnet phase comprises cerium.

17. The article of claim 16, wherein x is in the range from about 0.001 to about 0.50.

18. The article of claim 16, wherein x is in the range from about 0.001 to about 0.25.

19. The article of claim 11, wherein the garnet phase comprises lanthanum.

20. The article of claim 19, wherein x is in the range from about 0.001 to about 0.50.

21. The article of claim 19, wherein x is in the range from about 0.001 to about 0.25.

22. The article of claim 11, wherein the coating further comprises a secondary rare earth oxide.

23. The article of claim of claim 1, wherein the article is a condenser.

24. The article of claim 1, wherein the coating further comprises a surface texture.

25. The article of claim 1, wherein the surface connected porosity is up to about 1 percent by volume.

* * * * *